US005197580A

United States Patent [19]

Berman et al.

[11] Patent Number: 5,197,580

[45] Date of Patent: Mar. 30, 1993

[54] COLLAPSIBLE STRUCTURED LUGGAGE

[76] Inventors: Joseph J. Berman, 55 Mountain View Ter., Hillsdale, N.J. 07642; S. J. Chang, 13-3, Samjung-Dong Joon-Ku Buchun City Kyunggi-Do, Rep. of Korea

[21] Appl. No.: 638,379

[22] Filed: Jan. 7, 1991

[51] Int. Cl.[5] ..... A45C 7/00; A45C 5/14; A45C 13/36

[52] U.S. Cl. ..... 190/107; 190/18 A; 190/127

[58] Field of Search ..... 190/18 A, 100, 103, 190/105, 107, 119, 127; 383/97; 280/37, 47.26

[56] References Cited

U.S. PATENT DOCUMENTS

| | | | |
|---|---|---|---|
| 732,983 | 7/1903 | Whitney | 190/114 X |
| 948,165 | 2/1910 | Erstling | 190/124 |
| 2,282,408 | 5/1942 | Lowe | 190/100 |
| 2,699,848 | 1/1955 | Kaplan | 190/105 |
| 2,718,943 | 9/1955 | Braverman | 190/107 |
| 2,985,265 | 5/1961 | Gehrie | 190/903 X |
| 3,219,743 | 11/1965 | Berler | 190/903 X |
| 3,447,648 | 6/1969 | Schwennicke | 190/103 |
| 3,730,308 | 5/1973 | Pelavin | 190/903 X |
| 3,977,501 | 8/1976 | Alonso | 190/119 X |
| 4,210,230 | 7/1980 | Weiner | 190/107 |
| 4,215,769 | 8/1980 | Kuc | 190/18 A |
| 4,418,804 | 12/1983 | Bradley et al. | 280/37 X |
| 4,588,506 | 5/1986 | Bernbaum | 190/127 X |
| 4,589,530 | 5/1986 | Sher | 190/107 X |
| 4,655,329 | 4/1987 | Kaneko | 190/107 |
| 4,703,519 | 10/1987 | Krenzel | 190/903 X |
| 4,781,278 | 11/1988 | Sadow | 190/107 |
| 4,951,818 | 8/1990 | Johnson | 190/107 X |

FOREIGN PATENT DOCUMENTS

| | | | |
|---|---|---|---|
| 157968 | 10/1985 | Canada | 190/18 A |
| 647633 | 11/1928 | France | 190/119 |
| 940049 | 10/1963 | United Kingdom | 190/119 |
| 1208113 | 10/1970 | United Kingdom | 190/103 |
| 2184940 | 7/1987 | United Kingdom | 190/107 |

*Primary Examiner*—Sue A. Weaver

[57] ABSTRACT

This invention relates to a collapsible article of luggage or bag in which a plurality of pivotally mounted reinforcing panels and corner insertions permit the luggage to assume either a rigid or semi-rigid configuration or collapsed space-saving shape. Additionally, the top and bottom enclosure are secured to each other by a continuous zipper or slide fastener. This provides for ease of assembly by the manufacturer by merely zippering or fastening these elements together and welding the zipper at two points along its length to provide for permanent attachment of the top member to the bottom enclosure.

7 Claims, 6 Drawing Sheets

COLLAPSIBLE STRUCTURED LUGGAGE

BACKGROUND OF THE INVENTION

1. Field of the Invention

This invention relates to improved soft-sided structured luggage.

More particularly this invention relates to collapsible structured luggage which can be collapsed for storage by the user and which can be easily assembled by both the retailer and the user.

More specifically, this invention relates to a collapsible article of luggage in which a plurality of pivotally mounted rigid reinforcing or stiffening side panels and rigid corner insertions permit the luggage to assume either a rigid or semi rigid configuration or collapsed space saving shape. Additionally, the top cover member and bottom enclosure are secured to each other by a continuous zipper or slide fastener. This provides for ease of assembly by the manufacturer by merely zippering these elements together and welding the zipper or slide fastener at two points along its length to provide for permanent attachment of the top member to the bottom enclosure.

2. Prior Art

A common type of luggage is soft-sided structured luggage, which is formed of pliant material. Typically, one of the walls of the soft-sided luggage is hingeably mounted and constitutes a cover for the container or enclosure portion of the luggage. However, such soft-sided luggage can not be reduced in size when not in use. Such rigid or semi-rigid luggage is bulky in size when shipped or stored in an empty condition. The fixed external dimensions increase the volume occupied during shipment between the manufacturer, distributor and/or user and interfere with convenient space saving storage of the luggage at the wholesale and retail outlet, and the home. Attempts have been made in the past to provide collapsible luggage which when empty would be economical to ship and convenient to store.

Typically, known collapsible luggage is provided with stiffening inserts to create a structure of fixed dimensions. These designs, however, suffer from several defects that render them unsatisfactory for wide spread use, i.e. they are either inconvenient to use or rely on impractical designs. For example, such designs have included expansible bag inserts which are not suitably anchored in the erected bag causing such luggage to accidentally collapse in transport and handling. Further, some known "knock down" luggage is designed in a manner which adversely affects its ability to accommodate items within the bag because of frame cross structures. Further still, no known collapsible luggage has removable wheels.

More specifically, the following U.S. Pats. include some of the aforedescribed structures:

| U.S. Pat. No. | INVENTOR |
|---|---|
| 732,983 | Whitney |
| 948,165 | Erstling |
| 2,699,848 | Kaplan |
| 2,718,943 | Braverman |
| 3,447,648 | Schwennicke |
| 4,588,056 | Bernbaum |
| 4,589,530 | Sher |
| 4,655,329 | Kaneko |
| 4,781,278 | Sadow |

-continued

| U.S. Pat. No. | INVENTOR |
|---|---|
| 4,951,818 | Johnson |

U.S. Pat. No. 732,983 to Whitney describes a dress suitcase having a detachable tray. The suitcase has two lids (B) and (C) each having overlapping edges (See FIG. 2 of Whitney).

U.S. Pat. No. 948,165 to Erstling describes a handbag. The handbag has a bottom wall (1) which is formed by two sections which form extensions on the side walls and are united by a seam. Tacks (12) may be placed in the seam. (See FIGS. 2 and 3 of Erstling).

U.S. Pat. No. 2,699,848 to Kaolan describes foldable and adjustable luggage. The luggage is hard luggage wherein a pair of end frames are detachably assembled with a foldable body. The body is adapted to be collapsed into a flat condition when not in use to permit storage in a small area. The body is formed from a single piece of flat material, e.g. fibrous stock, foldable along lines extending transversely thereof midway between its ends. The construction of the luggage permits it to be sold with a single pair of end frames and a plurality of collapsible bodies differing from one another in respect to the size thereof. As a result, when a valise or trunk of a particular size is needed, one selects the body found most suitable for the specific occasion and assembles the selected body with the end frames. Such a structure may be stored in a small area when not in use.

U.S. Pat. No. 2,718,943 to Braverman describes a collapsible traveling bag. The bag may be readily reduced in size for storage. Referring to FIG. 1 of Braverman, the front wall is provided with an access opening which is closed by a flap. The flap may be closed and opened by a slide fastener or zipper and apparently, may be completely removed. The bag is provided with a collapsible frame. (See FIG. 3 of Braverman) for extending the bag from the operating condition. Wire frame extensions and which are on hinges pivot to extend the suitcase to its operating position. When collapsed the suitcase may be folded.

U.S. Pat. No. 3,447,648 to Schwennicke describes a variable volume suitcase. The suitcase has in it two rigid frames which extend along the edges of the two large opposite faces of the soft suitcase. The frames may be variably spaced from each other to change the volume of the suitcase.

U.S. Pat. No. 4,588,056 to Bernbaum describes a collapsible article of luggage which has internal stiffening panels. The stiffening panels may be released to an unsecured position to permit the luggage to collapse. In its reinforcing position, the stiffening panels are anchored by an elongated retaining member affixed thereto. For example, in FIGS. 3, 4, and 6 of Bernbaum the reinforcing members comprise a pair of rigid panels and which are sewn or otherwise attached to internal portions of the bag. Flexible strips of material, affixed to an edge portion of panel members and, are sewn or otherwise attached internally to the bag. The reinforcing panels and are not capable of swinging movement due to their attachment to the bag by flexible flaps, allowing the panels to be lifted away from the position shown in FIG. 4 of Bernbaum and to be rearranged in a position essentially parallel to walls.

Also provided are a pair of retention panels of a relatively rigid material which are sewn adjacent the bottom walls of walls and and may be swung from the position shown in FIG. 4 of Bernbaum to the position shown in FIG. 3 of Bernbaum. The retention panels may be affixed by hinge strips of flexible material in the manner of reinforcing panels as desired.

Strips of Velcro material are disposed along an edge portion of each of the reinforcing panels and are arranged to engage the corresponding Velcro strips formed on the retention members. Such anchoring of the end reinforcing panels expands the bag with a dimensional rigidity through expansible support of collapsible walls.

U.S. Pat. No. 4,589,530 to Sher describes luggage having a side stiffening board which, when removed, permits the luggage to collapse.

U.S. Pat. No. 4,655,329 to Kaneko describes luggage which is collapsible, the sides being freely foldable sheets of board (See FIGS. 1 and 2 of Kaneko).

U.S. Pat. No. 4,781,278 to Sadow describes soft luggage formable into "hard" luggage by a provision of axially extending stiffening members.

U.S. Pat. No. 4,951,818 to Johnson describes an equipment carrier having tensioning members held in pockets of the sides thereof (See FIG. 4 of Johnson). Additionally, the apparatus has wheels thereon.

OBJECTS AND SUMMARY OF THE INVENTION

It is an object of this invention to provide collapsible luggage to permit ease of storage in a minimum amount of space.

Another object of this invention is to provide a collapsible structured traveling bag having a flexible casing, provision being made to maintain the casing in the normal, bag-defining formation thereof and to provide a rigid backing for the side walls and corners of the bag.

Still another object of this invention is to provide a collapsible bag having a flexible covering, which bag is provided with a supporting or bag defining frame work which serves to reinforce the bag at those portions thereof which are most subject collapsing pressures.

A further object is to provide a traveling bag which is simple and inexpensive to manufacture and which is convenient in use and, which, when not in use, can be placed within a small space for storage.

It is yet another object of the present invention to provide an improved luggage the bottom of which has castors thereon.

It is still a further object of this invention to provide an improved collapsible luggage the wheels of which may be removably attached to the bottom thereof.

It is still another object of this invention to provide an improved luggage which is durable in use and collapsible.

It is a further object of this invention to provide an article of soft luggage of reduced weight vis-a-vis hard luggage, and which will retain a neat appearance without regard to whether it is overfilled or underfilled, and which closely simulates the appearance of an article of hard luggage, while at the same time preserving its ability to be collapsed into a substantially planer form for storage.

It is yet another object of this invention to provide for a procedure for manufacturing and assembling collapsible structured luggage which is simple and inexpensive.

These and other objects are attained in accordance with the present invention where there is provided an improved collapsible luggage in which a pair of pivotally mounted rigid reinforcing panels and rigid corner insertions permit the luggage to assume either a rigid or semi-rigid configuration or collapsed space saving shape. Additionally, the top cover member and bottom enclosure are secured to each other by a continuous zipper and slide fastener. This provides for ease of assembly by the manufacturer by merely zippering these elements together and welding the zipper or slide fastener at two points along its length to provide for permanent attachment of the top member to the bottom enclosure.

An article of luggage is further provided which comprises a bottom enclosure having a top opening, a bottom and sides which meet at corners, a cover member for the opening, a continuous first zipper element surrounding and mounted along the edges of the cover member, a continuous second zipper element for mating with the first zipper element surrounding and mounted along the edges of the opening, wherein the first and second zipper elements are secured to each other to fasten the cover member to the opening of the bottom enclosure, and wherein a portion of the zipper elements are substantially permanently joined together to prevent removal of the cover element from the bottom enclosure.

An article of luggage is further provided which comprises a bottom enclosure having a top opening, a bottom and sides which meet at corners, a cover member for the opening, an interior stiffening member pivotally attached along an edge of the cover member adapted to be removably secured to the interior of a side of the bottom enclosure for stiffening the side, an exterior stiffening member pivotally attached along the edge of the cover member adapted to be removably secured to the exterior side of the bottom enclosure for stiffening the side, another exterior stiffening member pivotally attached along an edge of the side adapted to be removably secured to the exterior of the side of the bottom enclosure for stiffening the side, and removable corner stiffening members secured against the interior of the corners of the bottom enclosure wherein when the removable corner stiffening members are removed and the exterior and interior stiffening members are not secured to the side the luggage collapses to a reduced volume.

A method of assembly of an article of luggage is further provided comprising providing a bottom enclosure having a top opening, a bottom and sides which meet at corners, providing a cover member for the opening, providing a continuous first zipper element mounted along the edges surrounding the cover member, providing a second continuous zipper element which mates with the first element mounted along the edges surrounding the opening, securing the first and second zipper elements to each other to fasten the cover member to the opening of the bottom enclosure, and substantially permanently joining together a portion of the first and second zipper elements to prevent removal of the cover element from the bottom enclosure.

A method of assembly of an article of luggage is further provided comprising providing a bottom enclosure having a top opening, a bottom and sides which meet at corners, providing a cover member for the opening, providing a continuous first zipper element mounted along the edges surrounding the cover member, providing a second continuous zipper element which mates with the first element mounted along the edges surrounding the opening, securing the first and second zipper elements to each other to fasten the cover member to the opening of the bottom enclosure, substantially permanently joining together a portion of the first and second zipper elements to prevent removal of the cover element from the bottom enclosure, providing an interior stiffening member pivotally attached along the edge of the cover member and adapted to be removably secured to the interior of a side of the bottom enclosure, providing an exterior stiffening member pivotally attached along the edge of the cover member and adapted to be removably secured to the exterior of the side of the bottom enclosure, providing another exterior stiffening member pivotally attached along an edge of the side of the bottom enclosure adapted to be removably secured to the exterior side of the bottom enclosure, providing removable corner stiffening members adapted to be secured to the interior corners of the bottom enclosure in pockets, securing the corner stiffening members to the interior corners of the bottom enclosure, securing the interior stiffening member to the interior of the side of the bottom enclosure, securing the exterior stiffening members to the exterior of the side, wherein the side is stiffened by the interior and exterior stiffening members and the corners are stiffened by the corner stiffening members to maintain the luggage in a non-collapsed state.

DETAILED DESCRIPTION OF THE INVENTION

Figure 1:
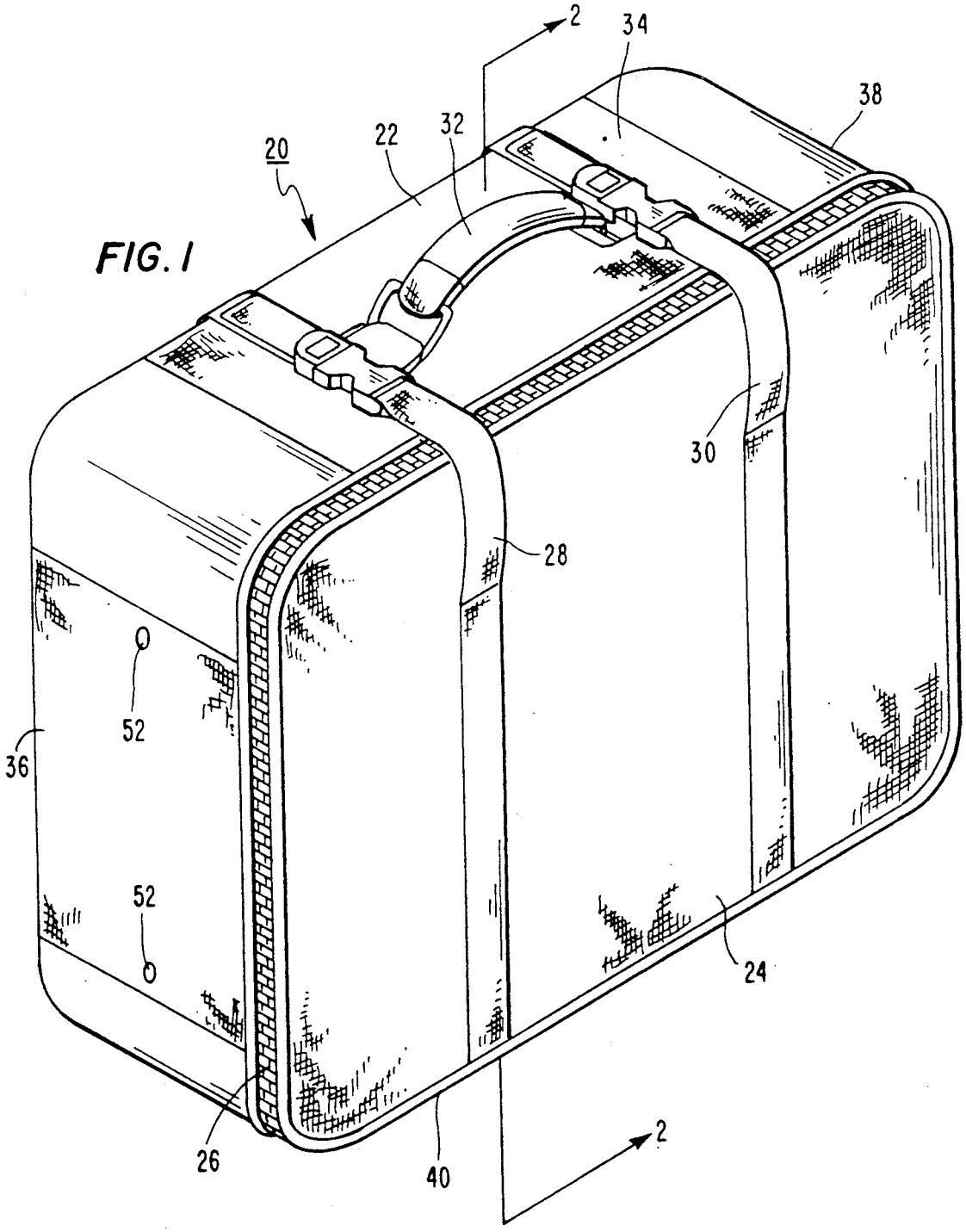
FIG. 1 is a perspective view of the exterior of the luggage of this invention in its expanded or rigid state.
Figure 2:
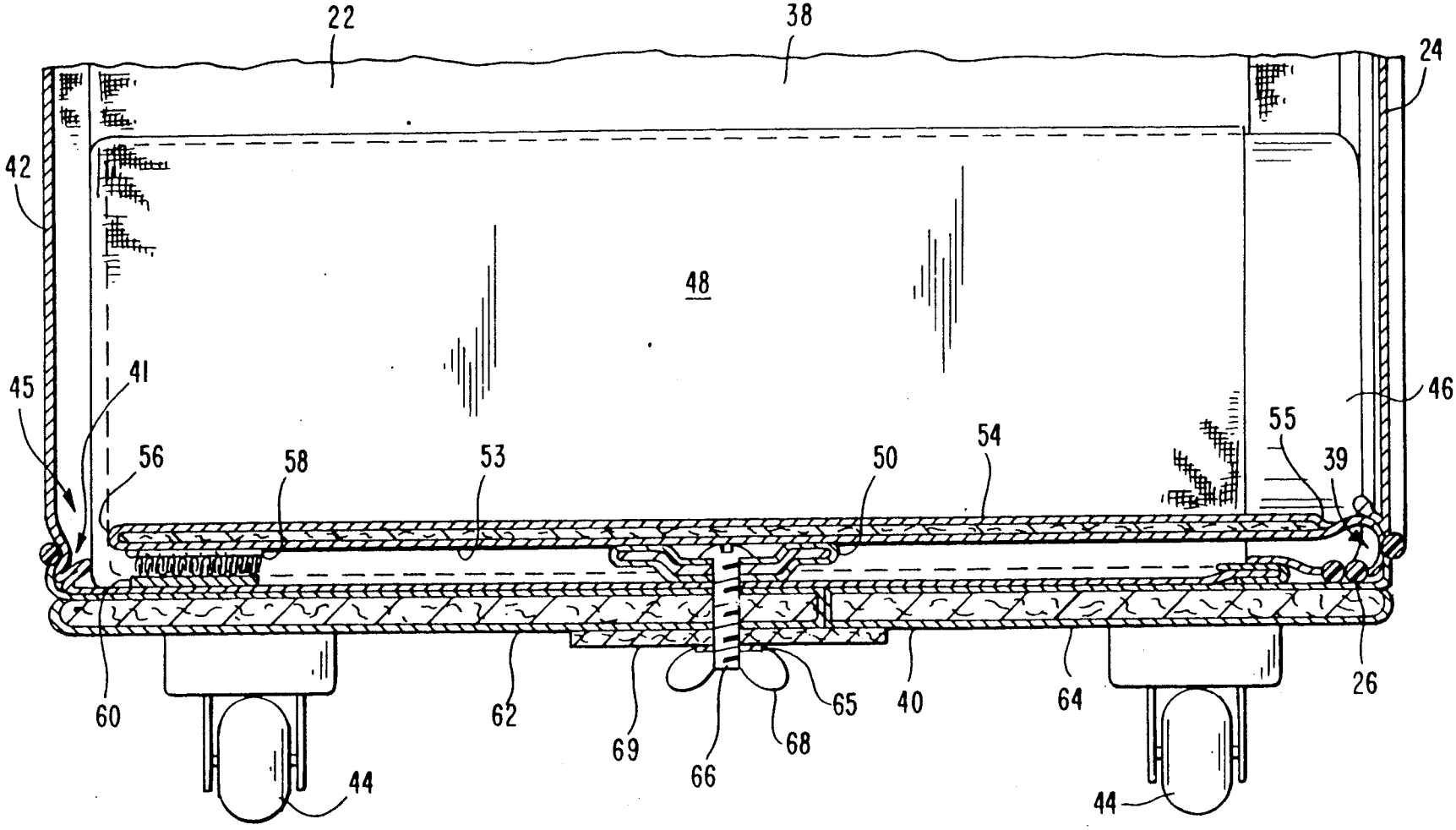
FIG. 2 is a partial cross sectional view of the luggage of this invention taken along line A—A of FIG. 1.
Figure 3:
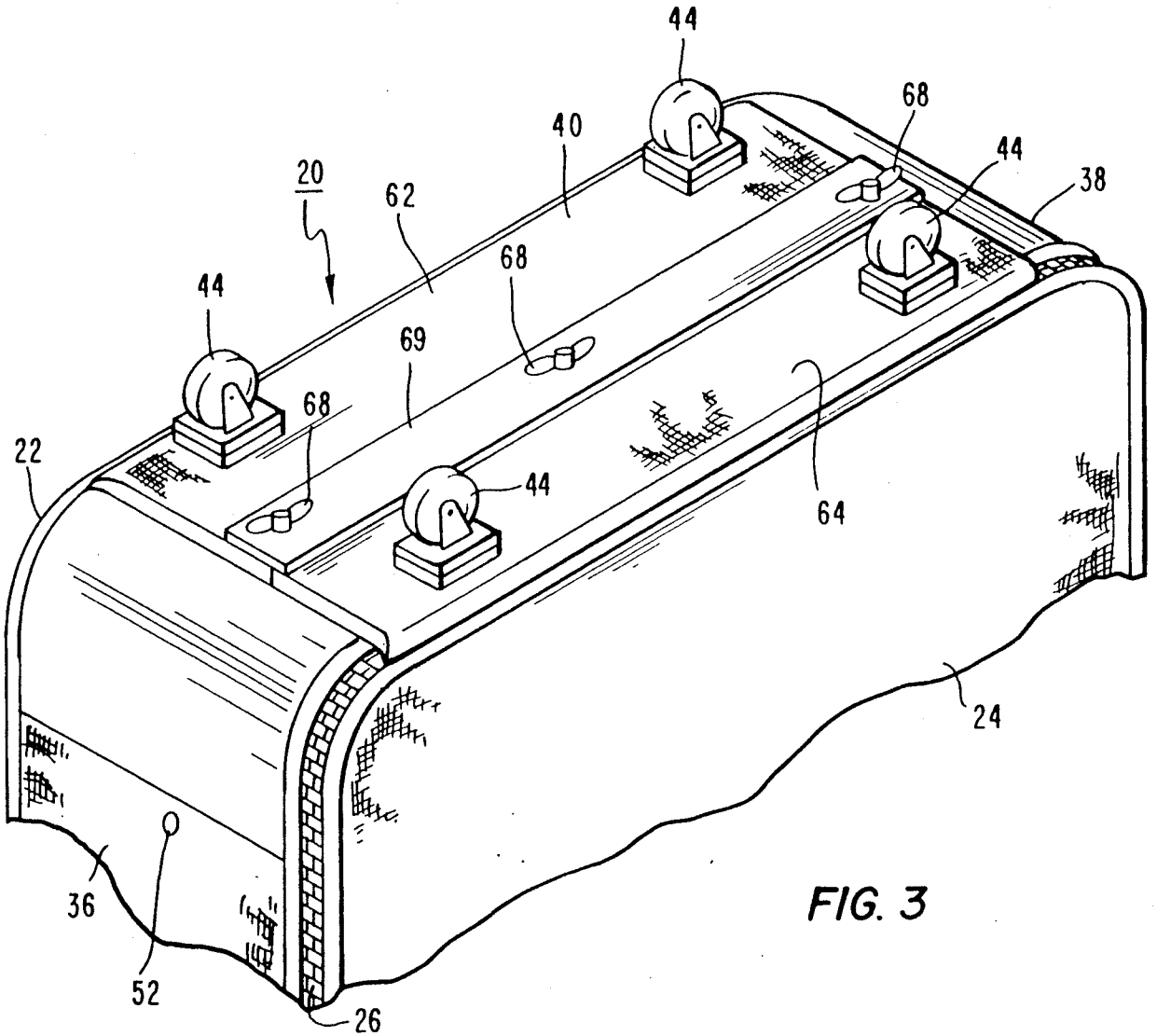
FIG. 3 is perspective view of the sidewall of the luggage of this invention having removable casters and stiffening members thereon.

Referring to FIG. 1, the luggage of this invention 20, has the outward appearance of the well-known type of luggage having soft pliable sides and structured to maintain a rigid or semi-rigid state. Typically, the luggage 20 comprises a bottom enclosure 22 and a top cover member 24 which are secured together by zipper or slide fastener 26. The bottom enclosure 22 further includes four side walls 34, 36, 38, and 40, and a bottom 42. The luggage 20 may have a plurality of straps 28, 30 thereon which can be fastened and unfastened to further secure the top cover member 24 to the bottom enclosure 22. The luggage 20 further has a handle 32 secured to a side wall 34 of the bottom enclosure 22. Referring to FIGS. 2 and 3, mounted on the exterior of side wall 40 are a plurality of wheels 44. Preferably, for convenience in shipping and storage, these wheels 44 are removably mounted to the side wall 40.

Figure 5:
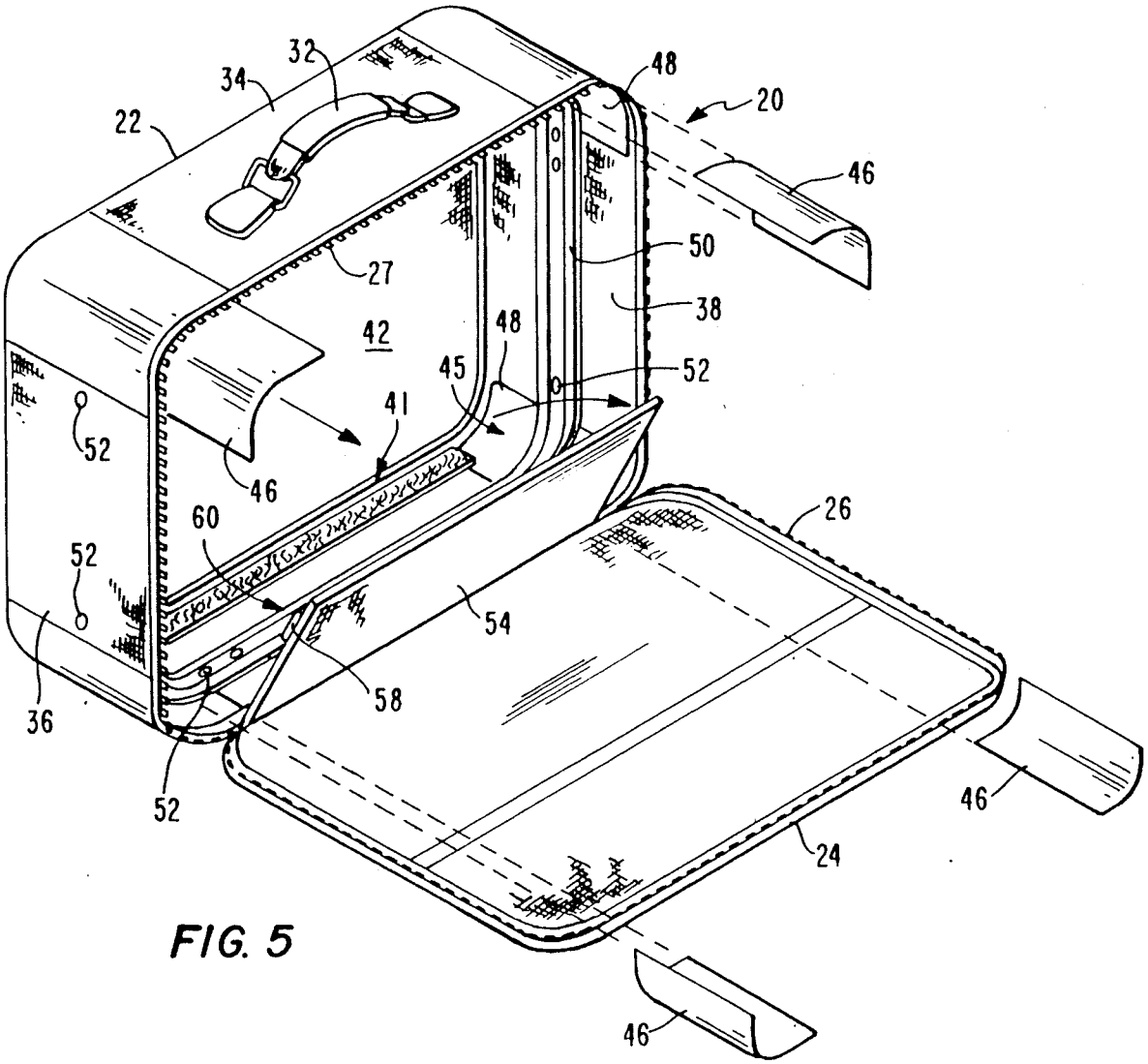
FIG. 5 is a perspective view of the luggage of this invention partially disassembled.

Referring to FIGS. 2 and 5, at the interior joinder of each side wall, i.e. corner 45, a removable rigid corner stiffening member 46, shaped to the contour of the corner is provided. These stiffening members 46 are made of a rigid plastic and are preferably inserted in pockets 48 formed in or secured or sewn to the interior corner 45 of the luggage 20. The pockets 48, may be provided with a fastening means to secure stiffening members 46 therein.

Referring to FIGS. 1 and 5, on the interior of the bottom enclosure 22 is a substantially continuous elongated structural member 50 which is mounted to each of the side walls 34, 36, 38, and 40 and overlays the pockets 48 in to which the stiffening members 46 are inserted. Each side wall contains a plurality of bolts or rivets 52 which secure the structural member 50 to the side walls 34, 36, 38, and 40. The structural member 50 is mounted approximately mid way between the bottom 42 and the top cover members 24. This structural member 50 prevents the side walls 34, 36, 38, and 40 from collapsing or closing in on the interior of the bottom enclosure 22 and additionally further secures the stiffening members 46 in the pockets 48. Preferably the structural member is made of extruded aluminum contoured to the interior of the bottom enclosure 22.

Figure 6:
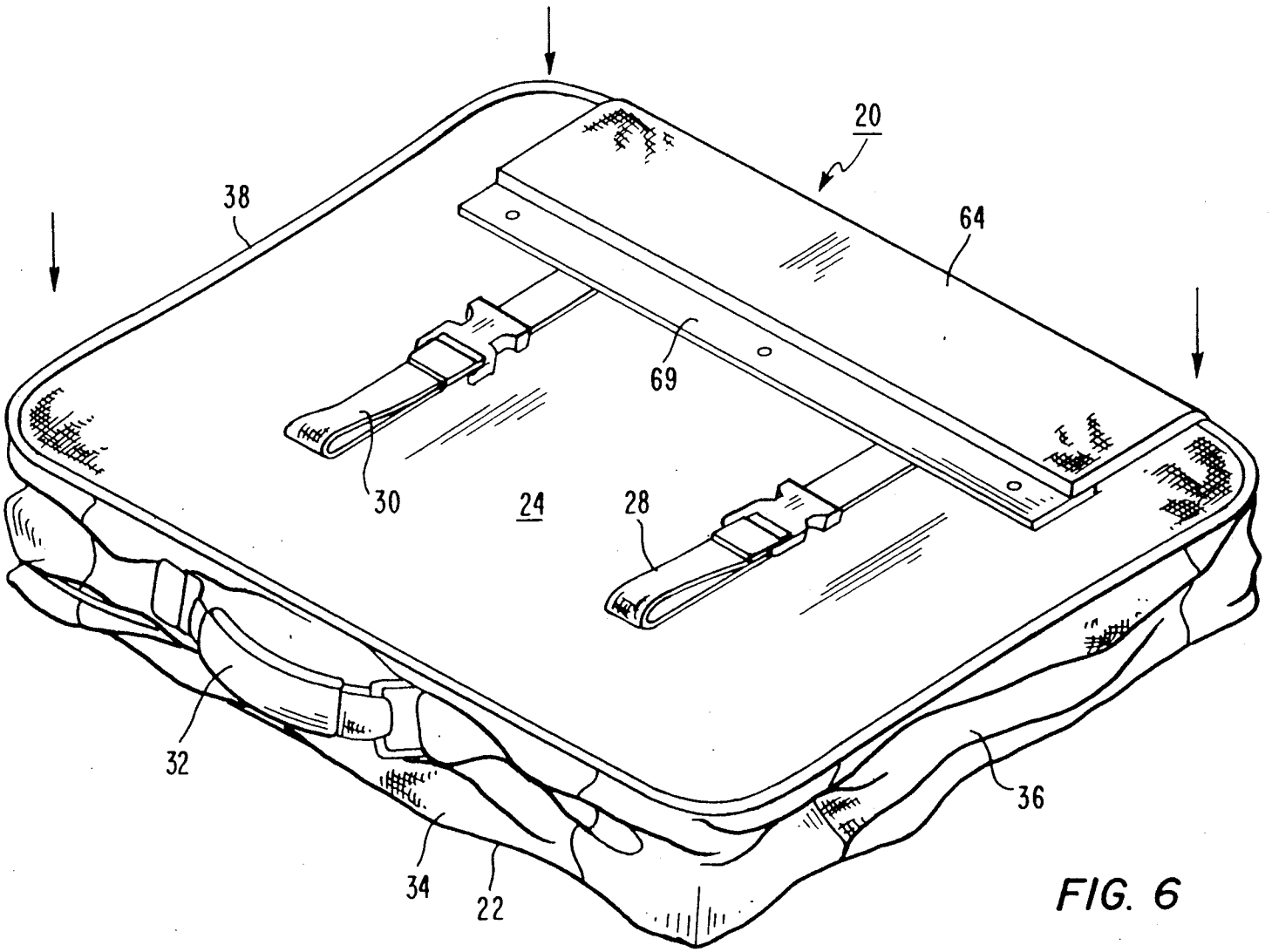
FIG. 6 is a perspective view of the exterior of the luggage of this invention in its collapsed state.

Referring to FIGS. 2, 5, and 6, on the interior of the bottom enclosure 22 is a rigid stiffening member 54 which is pivotally mounted along one edge 55 near the juncture 39 (or zipper 26) of the top of the side wall 40 and the top cover member 24. Preferably the stiffening member 54 is made of a stiff board like structure and is of a width such that the other edge 56 of the stiffening member 54 is in close proximity to the bottom 42 of the bottom enclosure 22. On the underside 53 of stiffening member 54 is fastening element 58, preferably a Velcro element, i.e. a hook or pile fastening element or a turn button. Attached to side wall 40 near the bottom 42 of the bottom enclosure 22 is the other fastening element 60 of, for example, the Velcro fastening means or a turn button.

Preferably, stiffening member 54 is mounted to the edge of cover member 24 to permit the further securing of cover member 24 to the bottom enclosure 22 when stiffening member 54 is secured to fastening elements 58 and 60 to the side wall 40.

Referring to FIGS. 2, 3, 4, and 6 the exterior of side wall 40 has thereon two overlapping exterior rigid stiffening members 64, 64 one (64) of which is hingeably attached to the junction 39 of the top cover member 24 and the side wall 40, typically along the exterior edge of the top cover member 24, and the other (62) of which is attached to the juncture 41 of side wall 40 and bottom 42. While the luggage is provided with two overlapping exterior rigid stiffening members in the preferred embodiment, in another embodiment, the luggage may be provided with only one stiffening member. These exterior stiffening members 62, 64 are secured to side wall 40 by a plurality of bolts 66, washers 65 and wing or acorn nuts 68. The bolts 66 pass through wall 40 and are covered by member 54 on the interior of the luggage 20. A strip 69, preferably made of leather, may be secured to one edge of member 64 to permit the members 62, 64 to lay flat.

Referring to FIGS. 1–5, the top cover member 24 has surrounding it a continuous zipper or slide fastener element 26 which mates with the continuous mating zipper element 27 on the top of bottom enclosure 22. At two places 70 and 72 underlying stiffening member 64, the zipper elements 26 are welded together to prevent the bottom enclosure 22 from separating from the top cover member 24.

Figure 4:
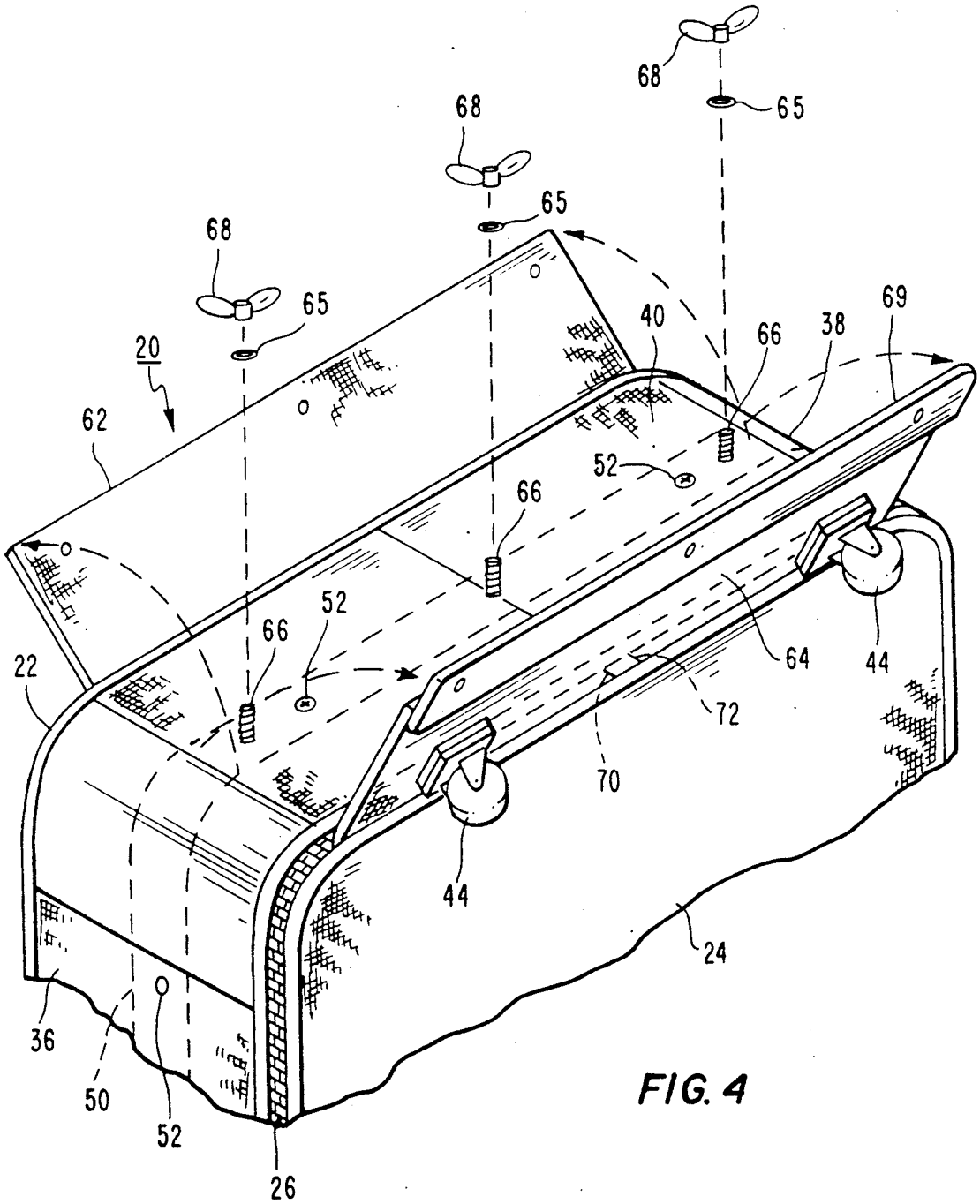
FIG. 4 is a perspective view of the sidewall of the luggage of this invention partially disassembled for collapsing the luggage.

The aforedescribed luggage has many benefits. Firstly, it may be easily assembled by a manufacturer in that cover member 24, 54, may be separately manufactured and then easily zippered to bottom enclosure member 22 and welds 70, 72 placed thereon to maintain the cover member 24 permanently thereon. The user of seller of the luggage may collapse the luggage 20 by unscrewing wing nuts 68 from bolts 66, as shown in FIG. 4, flipping back stiffening members 62, 64, detaching stiffening member 54 from sidewall 40 and removing stiffening members 46 from pockets 48. The luggage may then be collapsed around structural member 50, as shown in FIG. 6, to its collapsed position. This permits easy storage by the purchaser of the luggage, whether it be the store owner or the eventual user.

What I have shown and described are preferred embodiments of my invention. It will be understood that various changes may be made to the present intention without departing from the underlying idea or principles of the invention.

What is claimed is:

1. An article of luggage comprising:

a bottom enclosure having a top opening, a bottom and sides which meet at corners;

a cover member for the opening;

an interior stiffening member;

means for pivotally attached the interior stiffening member along an edge of the cover member;

means for removably securing the interior stiffening member to the interior of a side of the bottom enclosure for stiffening the side;

an exterior stiffening member;

means for pivotally attaching the exterior stiffening member to the edge of the cover member;

means for removably securing the exterior stiffening member to the exterior of the side of the bot om enclosure for stiffening the side;

a continuous first zipper element surrounding and mounted along the edges of the cover member;

a continuous second zipper element for mating with the first zipper element surrounding and mounted along the edges of the opening;

wherein the first and second zipper elements are secured to each other to fasten the cover member to the opening of the bottom enclosure, and wherein a portion of the zipper elements are fastened together to prevent removal of the cover element from the bottom enclosure.

2. The luggage of claim 1, wherein the means for removably securing the interior stiffening member to the interior side is a hook and pile fastening means.

3. The luggage of claim 1, wherein the means for removably securing the exterior stiffening member to the exterior of the side includes bolts.

4. The luggage of claim 1, further comprising another exterior stiffening member;

means for pivotally attaching said another exterior stiffening member along an edge of the side;

means for removably securing said another exterior stiffening member to the exterior side of the bottom enclosure for stiffening the side.

5. The luggage of claim 1, wherein the corners include removable corner stiffening members on the interior of the bottom enclosure.

6. The luggage of claim 4, wherein the means for removably securing the exterior stiffening members to the exterior of the side includes bolts.

7. An article of luggage comprising:

a bottom enclosure having a top opening, a bottom and sides which meet at corners;

a cover member for the opening;

an interior stiffening member;

means for pivotally attaching said interior stiffening member along an edge of the cover member;

means for removably securing the interior stiffening member to the interior of a side of the bottom enclosure for stiffening the side;

an exterior stiffening member;

means for pivotally attaching said exterior stiffening member along the edge of the cover member;

means for removably securing the exterior stiffening member to the exterior side of the bottom enclosure for stiffening the side;

another exterior stiffening member;

means for pivotally attaching said another exterior stiffening member along an edge of the side;

means for removably securing said another exterior stiffening member to the exterior of the side of the bottom enclosure for stiffening the side; and removable corner stiffening members secured against the interior of the corners of the bottom enclosure;

wherein when the removable corner stiffening members are removed and the exterior and interior stiffening members are not secured to the side, the luggage collapses to a reduced volume.

* * * * *